US005111551A

United States Patent [19]

Hollingsworth et al.

[11] Patent Number: 5,111,551

[45] Date of Patent: May 12, 1992

[54] COMPACT CARDING APPARATUS WITH SLIVER THREAD-UP AND METHOD

[75] Inventors: John D. Hollingsworth, Greenville; Joe K. Garrison, Piedmont; Joel C. Collins, Easley; William A. Warnock, deceased, late of Lyman, all of S.C.; by Lillith M. Weiskel, legal representative, Nahant, Mass.; by Muriel R. Nyberg, legal representative, Lake Worth, Fla.; by Charles F. Warnock, legal representative, Fort Collins, Colo.; by Lorraine Pergande, legal representative, Winter Haven, Fla.

[73] Assignee: John D. Hollingsworth on Wheels, Inc., Greenville, S.C. ; a part interest

[21] Appl. No.: 694,752

[22] Filed: May 2, 1991

Related U.S. Application Data

[62] Division of Ser. No. 352,394, May 16, 1989, Pat. No. 5,016,321, which is a division of Ser. No. 106,521, Oct. 9, 1987, Pat. No. 4,831,691.

[51] Int. Cl.[5] ..... D01H 5/72

[52] U.S. Cl. ..... 19/150; 19/159 R

[58] Field of Search ..... 19/98, 99, 100, 101, 19/102, 103, 104, 105, 106 R, 107, 110, 111, 112, 113, 114, 288, 150, 152, 153, 157, 159 R

[56] References Cited

U.S. PATENT DOCUMENTS

| | | | |
|---|---|---|---|
| 3,196,492 | 7/1965 | Binder et al. | 19/106 R |
| 3,825,975 | 7/1974 | Staeheli | 19/150 |
| 3,946,464 | 3/1976 | Meinke et al. | 19/150 |
| 4,501,048 | 2/1985 | Varga | 19/150 |
| 4,630,336 | 12/1986 | Schopwinkel et al. | 19/150 |
| 4,763,398 | 8/1988 | Bothner | 19/157 |
| 4,809,405 | 3/1989 | Bruderlin et al. | 19/159 R |
| 4,813,104 | 3/1989 | Hollingsworth et al. | 19/159 R |
| 4,965,912 | 10/1990 | Kluttermann et al. | 19/159 R |

*Primary Examiner*—Werner H. Schroeder
*Assistant Examiner*—Michael A. Neas
*Attorney, Agent, or Firm*—Cort Flint

[57] ABSTRACT

A compact carding apparatus is disclosed which includes a pair of upstanding carding cylinders (B) and (C) carried in a self-standing manner on a base frame (260). Cylinder (C) is carried generally atop cylinder (B) by mounting plates (272, 274) which allow radial movement of cylinder (C) to yield to large lumps passing between the cylinders. A chute feed (10) and coiler (192) are uniquely combined with the compact arrangement in a minimum of space and in a mobile construction so as to permit movement of either the chute or coiler away for access to the apparatus. The compact upstanding arrangement provides for mounting of a number of carding elements mounted about the two cylinders which include stationary plates (40, 42, 44, 46) on cylinder (B); and revolving flat assembly (E) and stationary carding plates (96, 123) on cylinder (C). An extended fiber path (P) is defined about cylinders (B) and (C) along which a transferred fiber mass may be effectively exposed for carding on both of its sides. Fibers may be subjected to a carding action over approximately 80 percent of the circumference of the carding cylinders. Automatic thread-up of a sliver produced on the carding apparatus is provided by perforated transport belts (150, 152) which collect a web (W) and condense it into sliver (S). Sliver (S) is subjected to excessive drafting by a pair of transfer rolls (168, 170) driven at a high relative speed. During excessive drafting, fibrous parts are pulled and separated from a start-up sliver to form a pointed end. The fibrous parts are removed by suction (184). Excessive drafting is terminated and the pointed sliver end is fed to an air trumpet (174) in which the sliver is condensed and fed to a pair of metering rolls (188, 186) for delivery into a coiler tube (190).

31 Claims, 10 Drawing Sheets

Fig. 7-A

Fig. 9.
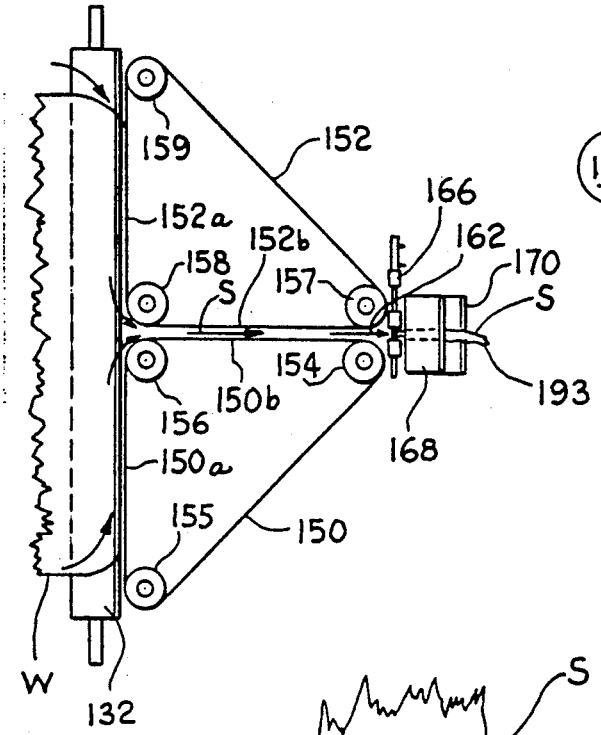
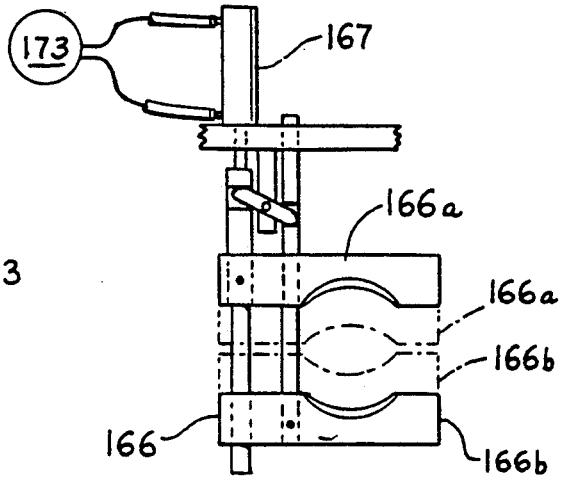
Fig. 10.
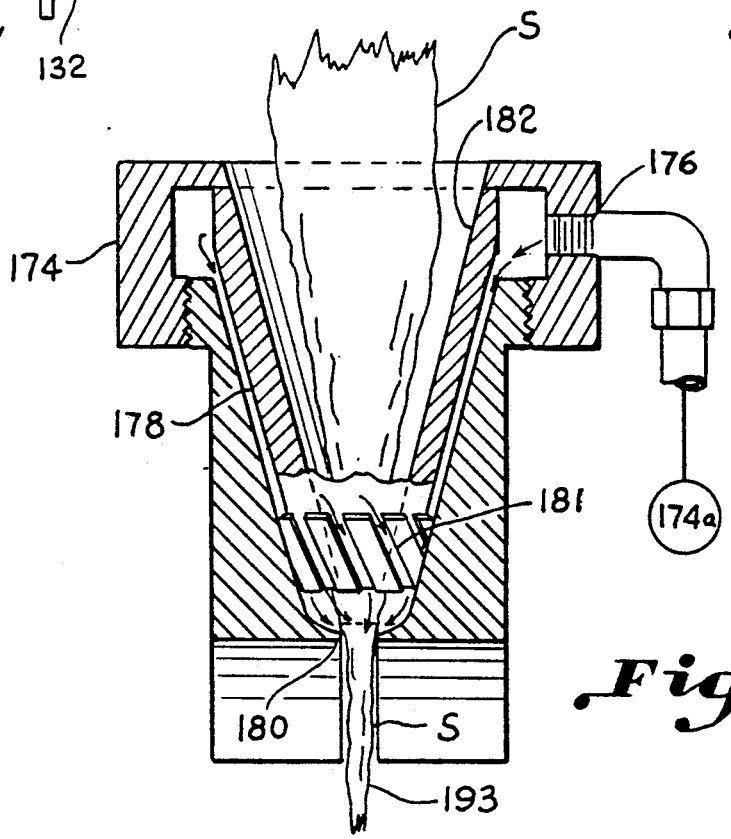
Fig. 8.

COMPACT CARDING APPARATUS WITH SLIVER THREAD-UP AND METHOD

This is a divisional of copending application Ser. No. 07/352,394, filed on May 16, 1989, now U.S. Pat. No. 5,016,321, which is a divisional of Ser. No. 106,521, filed on Oct. 9, 1987, now U.S. Pat. No. 4,831,691, issued on May 23, 1989

BACKGROUND OF THE INVENTION

The invention relates to new techniques and machines for carding textile fibers and particularly to the production of a high quality carded cotton fiber at increased production rate. Additionally, there is an increased ability to remove trash and seed coat particles while preserving fiber staple length. The present invention is designed for the "cotton system" and may be used with synthetic fibers as well as cotton.

Carding of fibers is the disentanglement, cleaning and intermixing of fibers to produce a continuous web or sliver suitable for subsequent processing. This is achieved by passing the fibers between moving surfaces covered with card clothing. Sliver is produced on a cotton card with revolving flats or stationary plates. Carding follows opening, blending, and in the case of cotton, a certain amount of cleaning of the bale material. Small turfs are fed to the card in the form of a lap or chute-fed fleece and, after a draft of 50–150, fibers leave the card in the form of a sliver, which may be direct-spun or subjected to further processing prior to the yarn formation operation.

Carding cylinders are typically clothed with metallic wire card clothing consisting of a steel strip with hardened teeth punched along the upper edge and wrapped about a cylindrical roll. The teeth are usually inclined at a prescribed angle. If the teeth of opposing relatively moving surfaces are opposed, the fibers are usually subjected to a carding action or a doffing action depending on the speeds. If the teeth are inclined in the same direction as they approach, then there usually is a stripping or transfer action.

Previously, "tandem" carding machines have been used to produce carded cotton fiber with a high degree of cleanliness and carding. Carding machines of the tandem type are shown in U.S. Pat. Nos. 2,097,046; 3,249,967; 3,097,399; and 4,128,917. These tandem carding machines typically include two carding cylinders arranged horizontally next to each other to provide doubled or increased carding. Carding takes place over the top portions of the cylinders with transfer from one cylinder to the other being carried out by various arrangements of transfer rolls. Due to the tandem arrangements and the fiber path over the top portions, effective carding action is limited to a good deal less than 50 percent of the cylinder circumference or surface area. Typically, the range of effective carding in prior tandem arrangements has been approximately from 20 to about 40 percent of each cylinder in tandem. In one tandem arrangement, a pair of horizontal tandem cylinders has been provided where fiber feeding, transfer, and doffing are done bottom portions of the cylinder to increase the top portion over which carding may be done. Stationary carding plates are used over the top carding area of each cylinder. Fibers may be carded over about 70 percent of the circumference of the tandem cylinders. This machine is manufactured by Hollingsworth, Inc., of Greenville, S.C., under the name Mastercard. Further, the arrangements of tandem carding cylinders in the prior art have required a large floor space and the tandem train arrangement makes the parts of the machine difficult to access and work on. Carding action has also been limited in the prior art by the revolving carding flat arrangements used, typically used in high quality tandem arrangements, where carding is limited to about ¼ inch at the heel of the flat, or over only about ⅓ of the carding flat.

A cotton cleaning machine and system is disclosed in U.S. Pat. No. 4,198,732, directed primarily to an improved suction plenum removable for machine inspection. This is a cleaning machine designed to clean exceedingly dirty cotton fibers. Carding and cleaning are done as fibrous stock travels over a top portion of a first cylinder and under the bottom portion of a second cylinder where a transferred fiber mass may be exposed for carding on both sides, even though not clearly apparent. This machine is designed primarily for opening, cleaning, and feeding loose fibers. A carded sliver or web is not produced as in the case of a conventional carding machine. Trash and short fibers that are not desirable for carding are extracted. The cleaned fibers are blown into a hopper for subsequent feeding to a chute feed of a conventional carding machine. The cleaning machine removes up to 25 percent of its input where a typical carding machine is designed to remove about 5 percent of its input.

U.S. Pat. No. 3,081,499 discloses a fiber intergrating apparatus for producing a carded web or sliver of cotton or synthetic fibers. A vertical arrangement of carding cylinders is designed to take adavantage of a vertical feed arrangement which relies primarily upon gravity and to provide for a carding in reduced space. The apparatus utilizes a triple feed roll arrangement in which two rows feed and one roll clears. The carding takes place mainly between the feed roll and first cylinder and in the transfer area between the first and second cylinders over a nose portion. Some additional carding takes place between a roughened surface of the covers and the cylinders. The surface area of each cylinder over which carding takes place is significantly limited relative to the total area of the cylinders and the carding action is limited. Smaller diameter rolls rotating at higher speeds than conventional carding cylinders are used to reduce loading through increased centrifugal force. However, capacity may be limited by the feed arrangement and limited carding action. While the vertical cylinder arrangement conserves space, the overall configuration, including fiber infeed and take-off does not lend itself to practical or efficient carding.

Conventional carding machines are typically fed by a feed roll/feed plate arrangement which delivers a fiber batt to a licker-in roll which feeds fibers directly to a main carding cylinder. Numerous variations of this arrangement have been proposed. For example, U.S. Pat. No. 4,524,492 discloses a triple licker-in roll arrangement. Two additional licker-in rolls are used to provide some carding and cleaning prior to the main cylinder. A primary catrding action takes place between the feed plate and the main carding cylinder. Some carding may also take place during the transfer action between the licker-in rolls. Cleaning is provided by the mote knives below the third licker-in roll. Centrifugal force slings out the heavy motes or trash particles which may be removed by suction.

In prior carding machines, the web is typically taken off by a doffer roll which forms the fibers into a web.

Following the doffer roll, a typical take-off may include a stripper roll which strips the fibers from the doffer and a pair of smooth delivery rolls which deliver the web to a trumpet or other condensor which condenses the web into a sliver. The sliver is then coiled into coiler cans by a conventional coiling device. Numerous and various take-off arrangements have been proposed for conventional carding machines. The problems encountered in taking off fiber from a card operating at increased production has been recognized. For example, U.S. Pat. No. 3,946,464 discloses a take-off belt arrangement. A pair of belts revolving parallel to the surface of the delivery rolls condense the web into a sliver which is delivered through a nip of the belts rotating about pulleys. The sliver is drawn off through a trumpet into a coiler head. The transverse belts are maintained in pressing support contact against the surface of the delivery rolls along substantially their entire length to avoid build up of fibers on the delivery rolls. However, it has been found at high production speed that this contacting arrangement may cause the problem it seeks to avoid and that fibers may actually wrap up around the delivery rolls. U.S. Pat, No. 3,825,975 discloses a similar take-off wherein a pair of revolving belts condense a web into a sliver for feeding to a coiler.

The principle of using a motive fluid to convey yarns and webs in textile applications is already known and is discussed in U.S. Pat. Nos. 3,970,231 and 3,976,237.

While various arrangements have been proposed for taking off fiber from a card, there has not been a satisfactory arrangement for starting a card and automatically threading sliver into a coiler can without manual assistance. Typically, when a card is started, the web is manually gathered and threaded through a trumpet where it is condensed as a sliver. Manual threading continues until the sliver is threaded into the coiler can. This is commonly referred to as bringing the end up on a carding machine to start the carding process. U.S. Pat. No. 3,196,492 proposes apparatus for piecing up a severed card web or sliver in an automatic manner. The web is pieced to a severed end of sliver. However, this piecing apparatus does not seek to provide complete threading-up of a sliver upon card start-up. This apparatus would not be effective for use in automatically threading-up sliver into a coiler can. At start-up, there is also the problem that the first, start-up part of the sliver is uneven and contains large lumps and other unwanted fibrous parts.

Accordingly, an object of the present invention is to provide a carding machine having increased production capacity without sacrificing the quality of the carded fibers.

Another object of the invention is the provision of a compact carding apparatus and method including a pair of clothed carding cylinders which provide a carding action substantially increased over that of the prior art and which cards both sides of a fiber mass being transferred between the cylinders contributing to thorough cleaning and parallelization of fibers.

Another object of the invention is to produce high quality carded sliver at high production rates with increased trash and mote particle removal while preserving fiber staple length and quality.

Another object of the present invention is to provide a compact arrangement for a carding machine having increased carding action and capacity.

Another object of the invention is to provide a compact arrangement for a carding machine in which more of the total surface area of the carding cylinders may be utilized for increased carding action.

Yet another object of the invenntion is to provide a compact carding apparatus and method which utilize reduced floor space by employing a pair of small carding cylinders and where high quality carded fiber is provided by utilizing more of the surface area of the small carding cylinders for carding.

Still another object of the invention is to provide a compact carding arrangement wherein upstanding carding cylinders provide increased carding area and accessibility to the apparatus for servicing, operation, and direct connecting to associated fiber feeding and sliver or web delivery machinery.

Still another object of the invention is to provide a carding machine having a take-off which automatically threads sliver into a coiler can of a coiler upon start-up.

Another object of the invention is to provide apparatus for automatically threading the sliver of a condensed web into a coiler can of a coiler.

SUMMARY OF THE INVENTION

The above objectives are accomplished according to the present invention by providing a compact textile carding apparatus which includes a pair of clothed carding cylinders consisting of a first carding cylinder and a second carding cylinder carried in a generally vertical arrangement with the first and second carding cylinders being in direct fiber transfer relation at a fiber transfer zone. A fiber feed device feeds fiber to the first carding cylinder at a fiber feed zone disposed on one side of a plane passing through the axes of the cylinders. A fiber doffing device removes fiber from the second carding cylinder at a fiber doffing zone which is disposed on an opposite side of the plane of the cylinders. Preferably, the first carding cylinder, which is fed, is on the bottom and the second carding cylinder is on the top of a generally vertical arrangement. A plurality of clothed stationary carding plates are carried adjacent the first carding cylinder in a carding relation. A revolving assembly of clothed carding flats is carried next to the second carding cylinder in a carding relation for carding and cleaning. The stationary carding plates of the first cylinder card the fibers and progressively break down the fibers into smaller tufts. The second cylinder cards and cleans the fibers which have been carded on the first cylinder and finishes the carding process. A fiber path is defined from the fiber feed zone, fiber transfer zone, and fiber doffing zone, aalong which the fibers may be subjected to a carding action over a surface area substantially greater than 50 percent to about 80 percent of the total surface area of each of the first and second carding cylinders. The carding cylinders preferably have a diameter of approximately 24 inches and the doffing device includes a small 5 inch diameter doffing roll to remove fibers and form a web. The assembly of revolving carding flats may be driven in reversed directions. The carding flats may be mounted tangential to the second carding cylinder for effective carding in either direction. The tangential flats provide efficient cleaning and carding in combination with the smaller carding cylinders. Advantageously, the first and second carding cylinders are mounted in a self-standing manner on a frame. The second cylinder is mounted directly to the bottom cylinder by a mount that allows the second cylinder to move radially outwardly should a large fiber mass or lump pass between the cylinders. In the fiber transfer zone, means for controlling the airflow to effectuate the fiber transfer are provided. The cylinders are clothed and driven so that the inside of the fiber mass is transferred onto the second cylinder as the outside of the fiber mass so that both sides are carded. Numerous other air control features provide efficient air currents for fiber feeding, carding, transfer, and doffing.

Apparatus for automatically thread-up a textile sliver produced from a web on the compact carding apparatus is provided by a transport device which collects the web and condenses the web into a sliver for transportation to a pair of transfer rolls. The transfer rolls redirect the sliver downwardly through an air trumpet which condenses the sliver. The sliver is drawn through the air trumpet and deposited in a coiling can. During start-up, the sliver may be automatically threaded into the coiler can. First, the transfer rolls are driven at an increased speed relative to the transport device subjecting the sliver to excessive drafting causing fibrous parts of the start-up to be pulled apart and separated from the sliver. The separated, fibrous parts of the sliver are conveyed by suction. Pulling and separating the fibers from the end of the sliver forms a generally pointed thread-up end which may be easily inserted into the air trumpet. After the thread-up end is formed, the transfer rolls are returned to their normal delivery speed matched to that of the transport device. The air suction is cut off also. The pointed thread-up end is threaded into the air trumpet. Air injected through the air trumpet produces a vortex air flow at the outlet of the trumpet. The vortex air flow twists the thread-up end of the sliver and makes it more pointed to facilitate thrreading into a metering passage in a tongue-in-groove calendar roll arrangement. The calendar rolls draw the condensed sliver through the air trumpet and deliver the silver to the coiling can.

A method of carding textile fibers on a pair of clothed carding cylinders consisting of a first carding cylinder and a second carding cylinder arranged one above the other includes feeding fibers to the first carding cylinder and carding the fibers over a surface area of the carding cylinder substantially greater than 50 percent and up to about 80 percent of the cylinder. The fibers are transferred directly onto a second carding cylinder at a fiber transfer zone and carded over a surface area of the second carding cylinder substantially greater than 50 percent up to 80 percent. Next, the fibers are doffed and formed into a web which is collected and condensed into a sliver. The sliver is subjected to extreme drafting, causing fibrous parts of the sliver to be separated from the sliver and to form a thread-up end on the sliver. The fibrous parts are conveyed away. After the thread-up end is formed, excessive drafting and conveyance of fibers is terminated. The thread-up end is then threaded into an air trumpet, condensed, and may be deposited in a coiler can automatically.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

FIG. *7a* is a corresponding sectional view illustrating a prior art arrangement.

Figure 3:
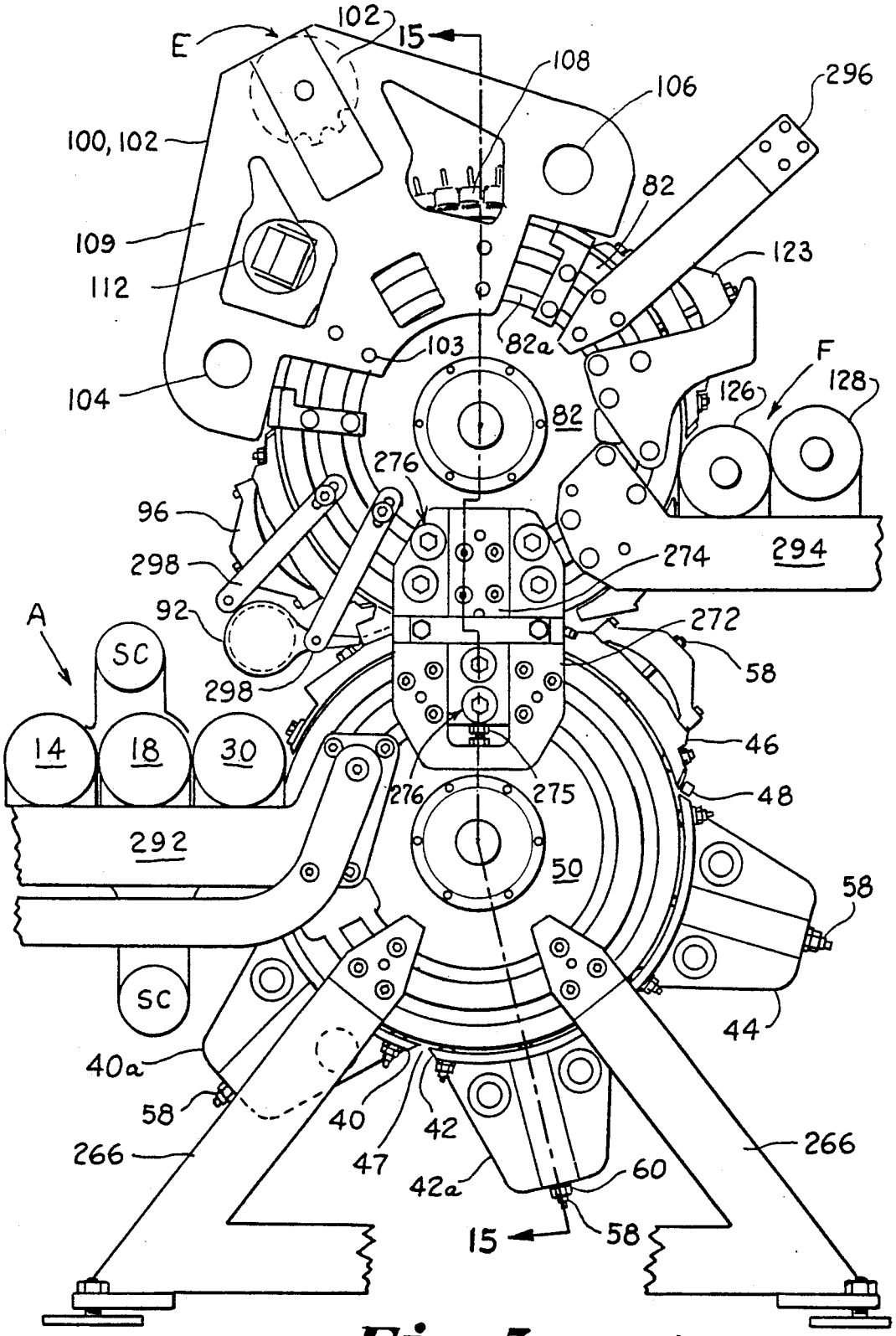
FIG. 3 is a detailed side view of carding apparatus and method according to the invention.
Figure 13:
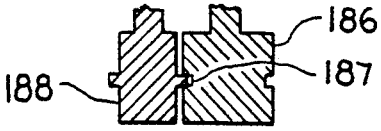
Figure 12:
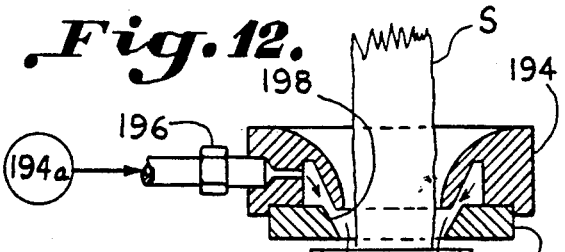
Figure 11:
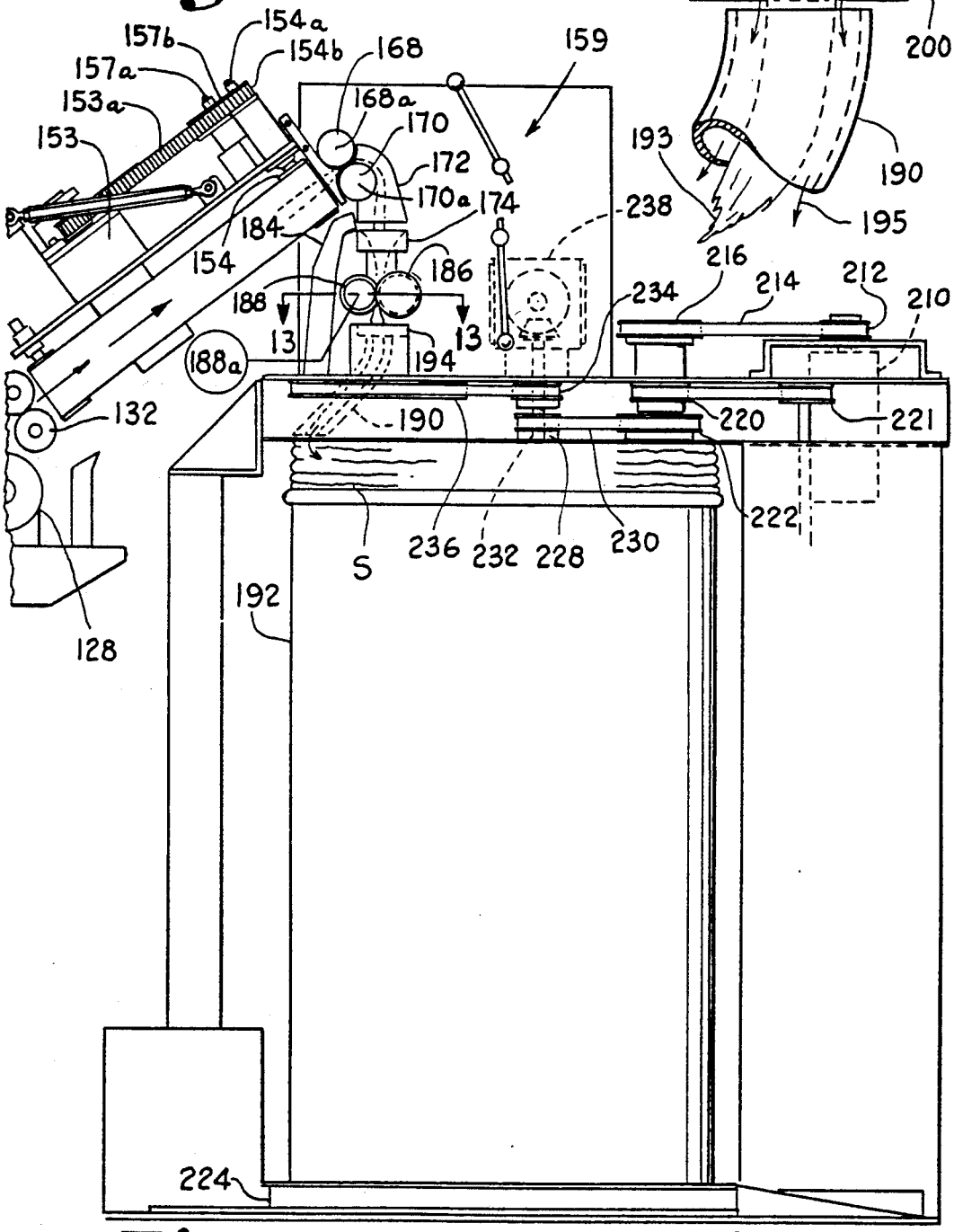
Figure 14:
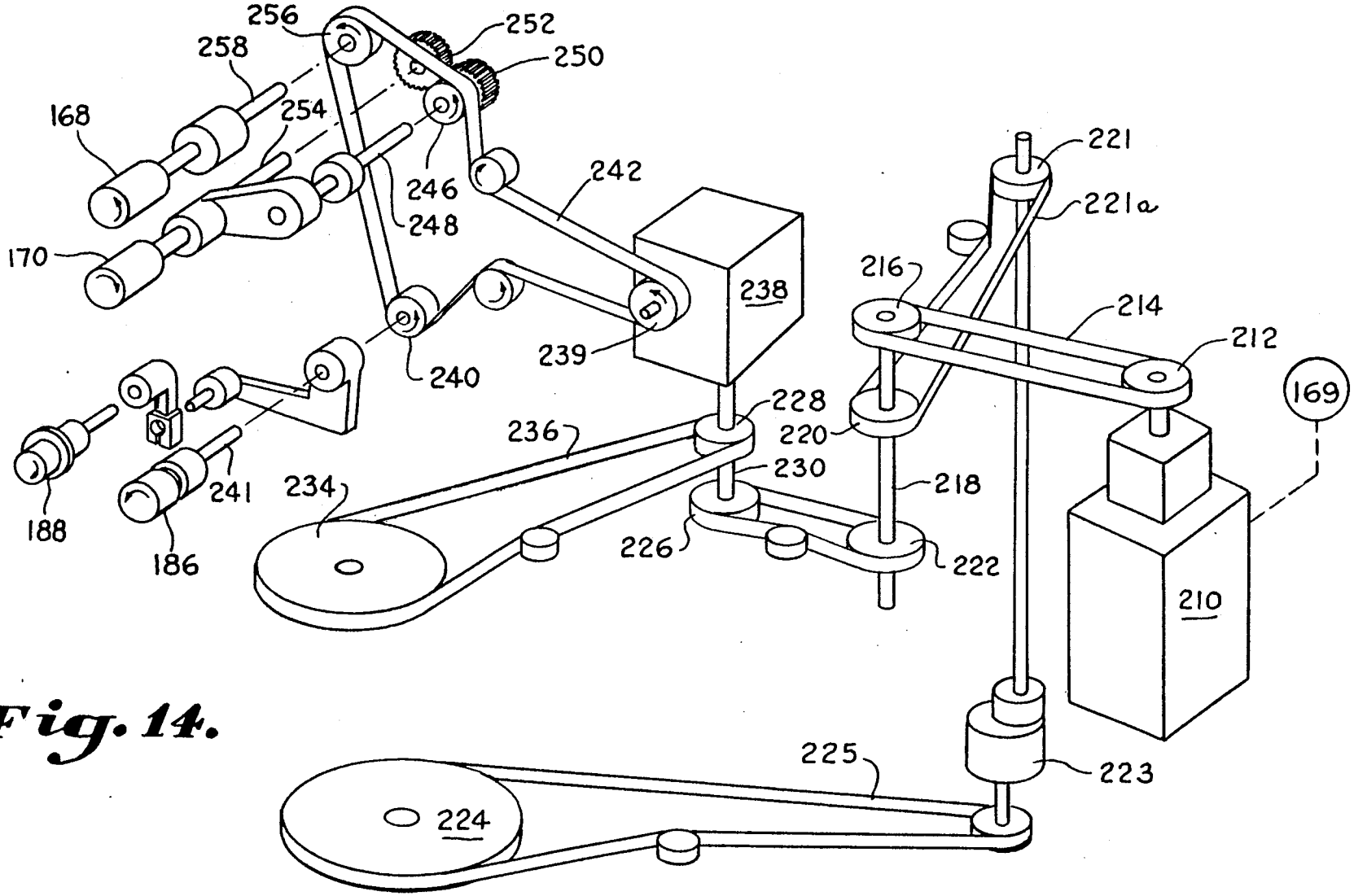
Figures 15, 16:
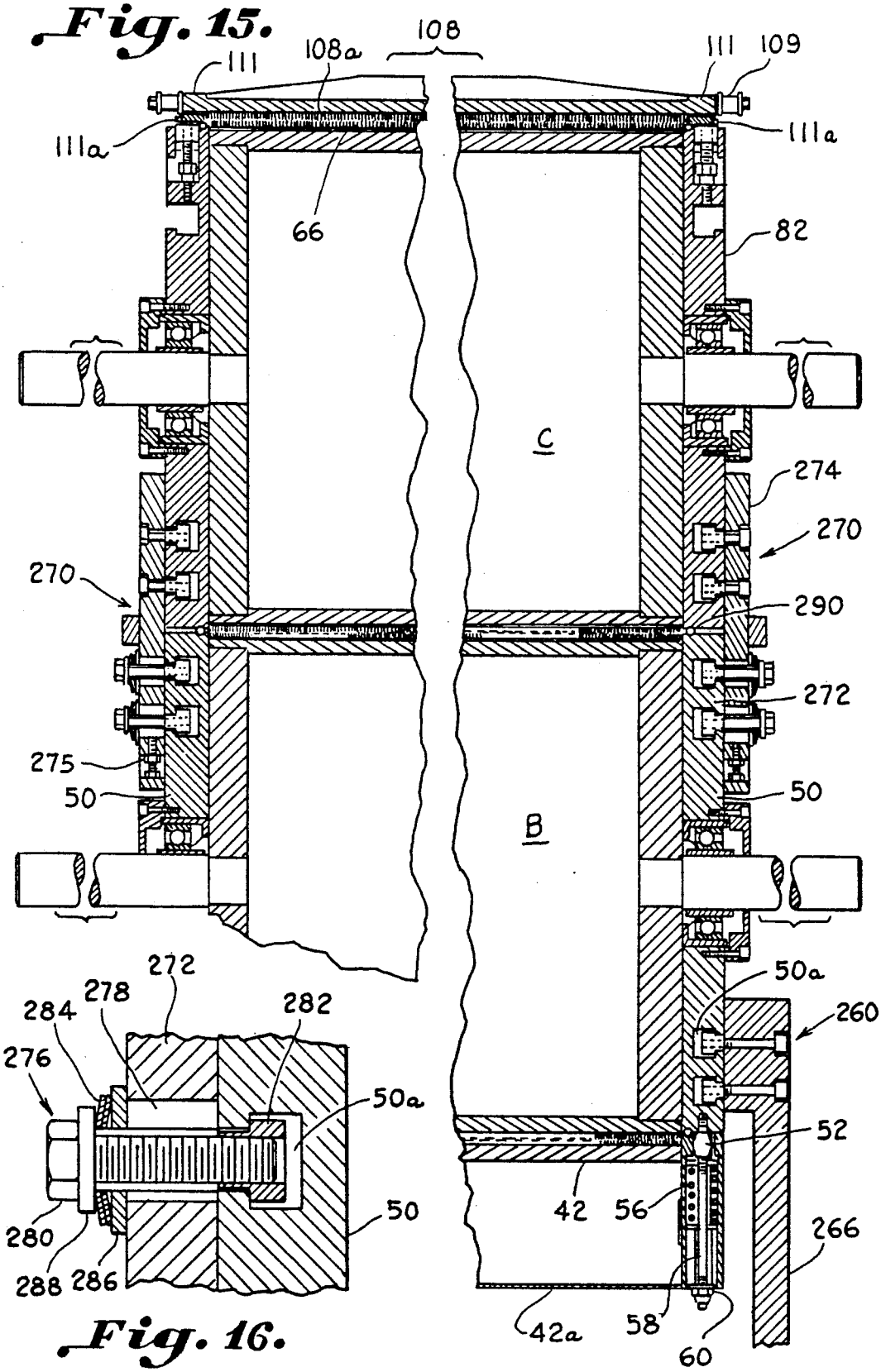

FIG. 8 is a sectional view of an air trumpet for automatically threading a sliver according to the invention;

FIG. 9 is a top plan view illustrating web take-off and method for use in automatically threading-up sliver according to the invention;

FIG. 10 is a front elevation of a segmented trumpet for controlling sliver spread in accordance with the method and apparatus of the present invention;

FIG. 11 is a side elevation illustrating the web take-off and automatic thread-up apparatus and method of the present invention;

FIG. 12 is a sectional view of an air trumpet used to assist the automatic threading of sliver into a coiler can according to the invention;

FIG. 13 is a sectional view taken along line 13—13 of FIG. 11;

FIG. 14 is a perspective view of a coiler drive in accordance with the invention;

FIG. 15 is a sectional view taken along line 15—15 of FIG. 3; and

FIG. 16 is an enlarged sectional view of an attachement permitting sliding movement between the mounting plates and cylinders in accordance with the invention.

DESCRIPTION OF A PREFERRED EMBODIMENT

Referring now in more detail to the drawings, a vertical chute feed is illustratrd at 10 which may be a conventional chute feed machine as disclosed in U.S. Pat. No. 4,476,611. The chute feed receives loose fibers delivered by a fiber laden air flow and compacts them into a compacted fiber batt 12 which is discharged to a feed roll 14 of a fiber feed means, denoted generally as A, of the carding apparatus. The disclosure of U.S. Pat. No. 4,476,611 is incorporated in this application by reference and may be referred to for detail. A suitable vertical chute feed is manufactured by Hergeth Hollingsworth GmbH of Duelman, West Germany, under the name Masterchute. Other means for feeding a fibrous stock to feed roll 14 may also be used.

FIBER FEEDING

Figure 1:
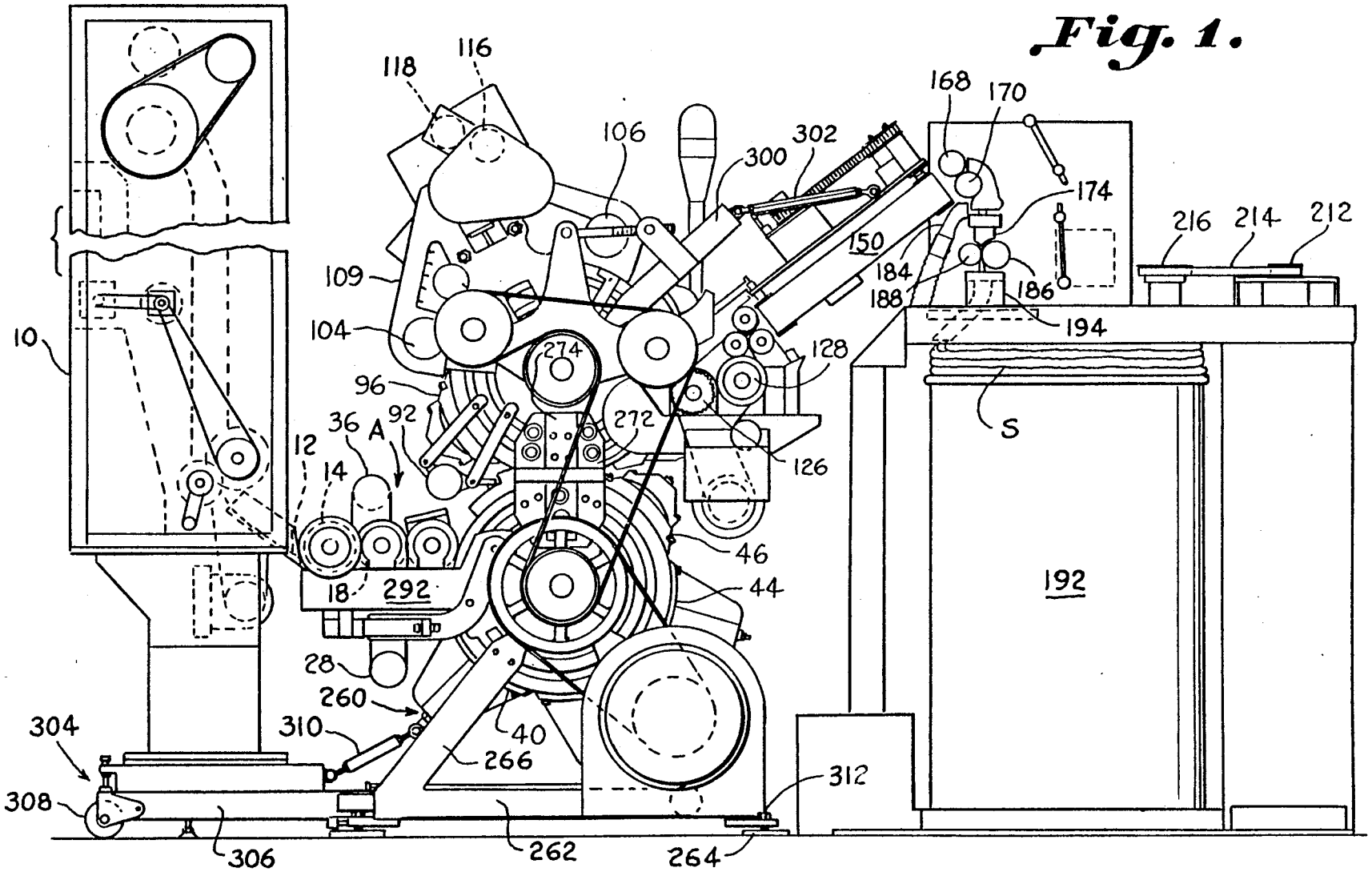
Fig. 1 is a side elevation of carding apparatus constructed in accordance with the present invention.
Figure 2:
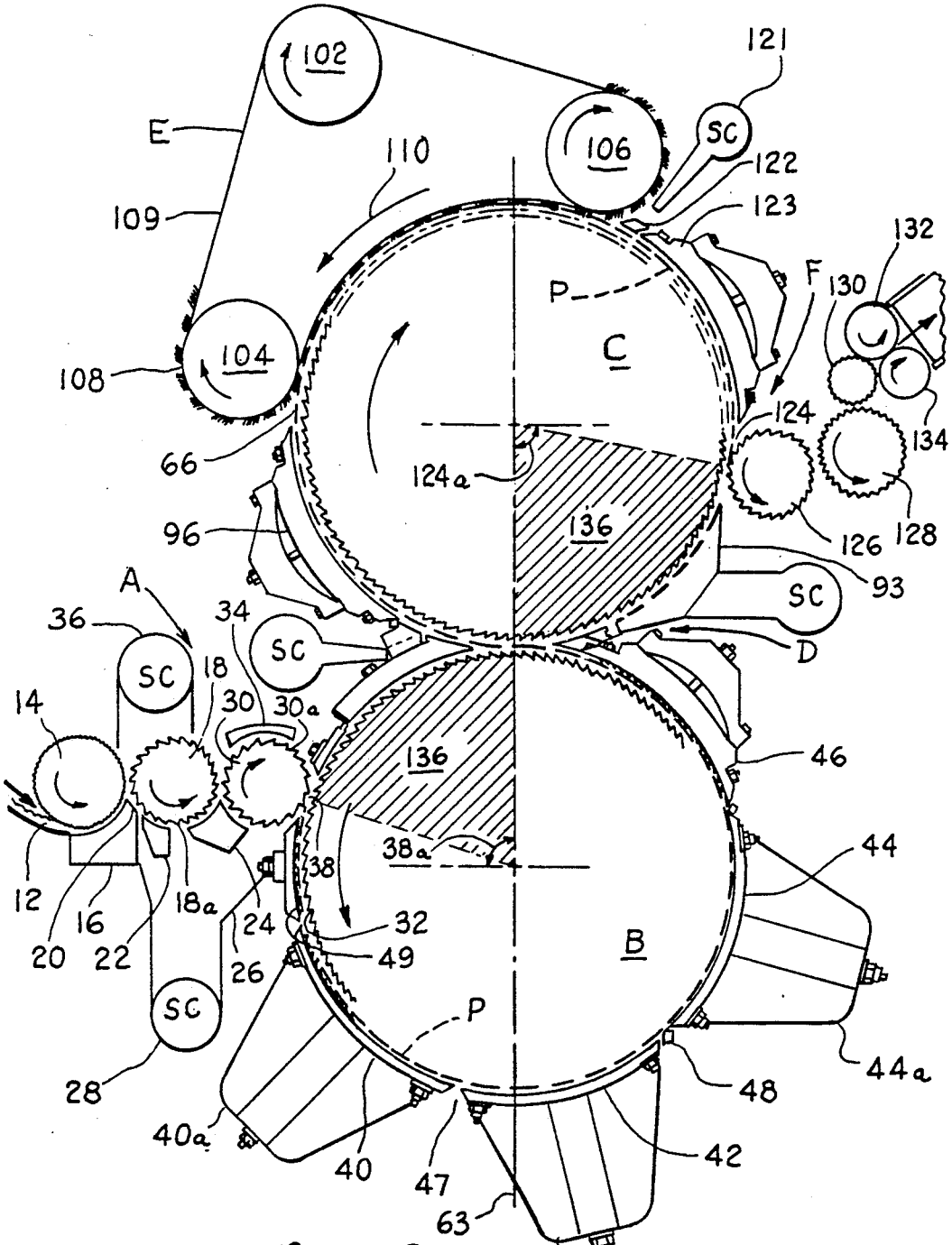
FIG. 2 is a schematic diagram illustrating the various infeed rolls, carding cylinders and elements, and take-off rolls and the fiber passage route of the carding apparatus and method according to the present invention.

As can best be seen in FIG. 2 fibers from batt 12 are fed by feed roll 14 over a feed plate 16. A licker-in roll 18 combs the fibers over a nose 20 of feed plate 16 and pulls fiber tufts from the fiber batt. Feed roll 14 and licker-in 18 rotate in the same direction as shown. Licker-in 18 is rotated at a very high speed relative to feed roll 14. For example, feed roll 14 may rotate at 5 rpm while licker-in 18 rotates at 2,000 rpm. A first mote knife 22 is disposed adjacent licker-in 18. A second mote knife 24 is disposed adjacent mote knife 22 below licker-in 18. Due to centrifugal force and the mote knife edge, the motes and trash particles are thrown outwardly. The particles fall into a collection pan 26 for removal by a suction sorce SC at 28. A transfer and redirected roll 30 rotating in a clockwise rotation picks up fibers from licker-in 18, and redirects and transfers fibers onto the surface of a first carding cylinder B which, as illustrated, is a lower carding cylinder. Transfer roll 30 is the same diameter as licker-in 18 but rotates slightly faster, for example, 10 percent faster. Feed roll 14, licker-in 18, and transfer roll 30 are preferably 5½ inch diameter rolls. Additional opening of the fibers takes place at a carding segment 34 over the transfer roll 30. For the purpose described previously, feed roll 14 is preferably a knurled roll. Licker-in 18 and transfer roll 30 may be clothed with any conventional metallic wire used on specialty rolls, i.e. rolls other than the carding cylinder and doffer such as licker-in, redirect, and transfer rolls, such as standard metallic specialty roll wire available from Hollingsworth, Inc., of Greenville, S.C. Carding segment 34 is preferably in the form of a stationary carding plate such as the curved segment shown in U.S. Pat. No. 3,604,602 clothed with conventional metallic wire card clothing. Air from the rapidly rotating licker-in 18 causes fly at the nip of feed roll 14 which may be removed by a suction SC at 36.

FIBER CARDING AND CLEANING

As can best be seen in FIG. 2, a first clothed carding cylinder B rotates counterclockwise and takes the fiber off of transfer roll 30. For this purpose, the surface speed of carding cylinder B is approximately 20 percent faster than transfer roll 30. Cylinder B is preferably a 24 inch diameter roll and may be clothed with conventional metallic wire card clothing. Preferably, the cylinder may be clothed with a tooth point population of about 850 points per square inch. Teeth 32 of carding cylinder B are inclined in the same direction as teeth 30*a* of transfer roll 30 at the transfer point and take fibers off the back of teeth 30*a* at a fiber feed zone 38 in which the fiber transfer takes place. Fiber feed zone 38 is preferably within the general area of a quardrant 38*a* of cylinder B next adjacent a fiber transfer zone D. This maximizes fiber path, compactness, and carding area.

As can best be seen in FIGS. 2 and 3, first carding means carried in carding relation to carding cylinder B includes stationary clothed carding plates 40, 42, 44, and 46. Carding relation means the teeth of cylinder B and the carding plates are inclined against each other to subject the fibers to a carding action. It will be understood that when reference is made to carding on a cylinder, roll, plate, flat, or other carding element, or its surface, this means the opposing points of the wire or teeth on the cylinder, roll, plate, flat, etc., which are in an opposing relationship. First stationary carding plate 40 is carried downstream of the transfer roll 30 and feed zone 38, and second carding plate 42 is adjacent carding plate 40. Carding plates 40, 42 are coarse carding plates clothed with standard metallic wire card clothing. Carding plates 40, 42 may be conventional carding plates manufactured by Hollingsworth, Inc. under the name Cardmaster. Next to carding plate 42 is third carding plate 44. Each includes a stiffener cover 40*a*, 42*a*, 44*a* to maintain the plate flat across cylinder B. Next to carding plate 44 is a fourth carding plate 46 having a somewhat different stiffener 46*a* due to a limited space in which it is arranged. Carding plates 44, 46 preferably may be fine carding plates clothed with conventional metallic wire card clothing which is finer than the clothing of coarse carding plate 40, 42. Plates 44, 46 may be Cardmaster plates having a point population of about twice that of the coarse carding plates, e.g. 950 and 400 points per square inch. During the carding process, the fiber tufts are progressively reduced in size. First, coarse carding plates 40, 42 reduce the fiber in size. Next, the fine carding plates 44, 46 reduced the size of the fiber tufts even further as the carding process continues. Small slit openings 47 between the adjacent carding plates may be sealed by suitable sealing means such as magnetic strips 48. Sealing openings 47 assist in controlling air currents and prevent the possible loss of fiber-laden air.

It is desirable that the carding plates are the same size for interchangability. This leaves a space immediately below redirect roll 30 in which there is no interchangeable carding plate. There is cover plate 49 to cover the cylinder in this area which may or may not have card clothing.

Figure 5:
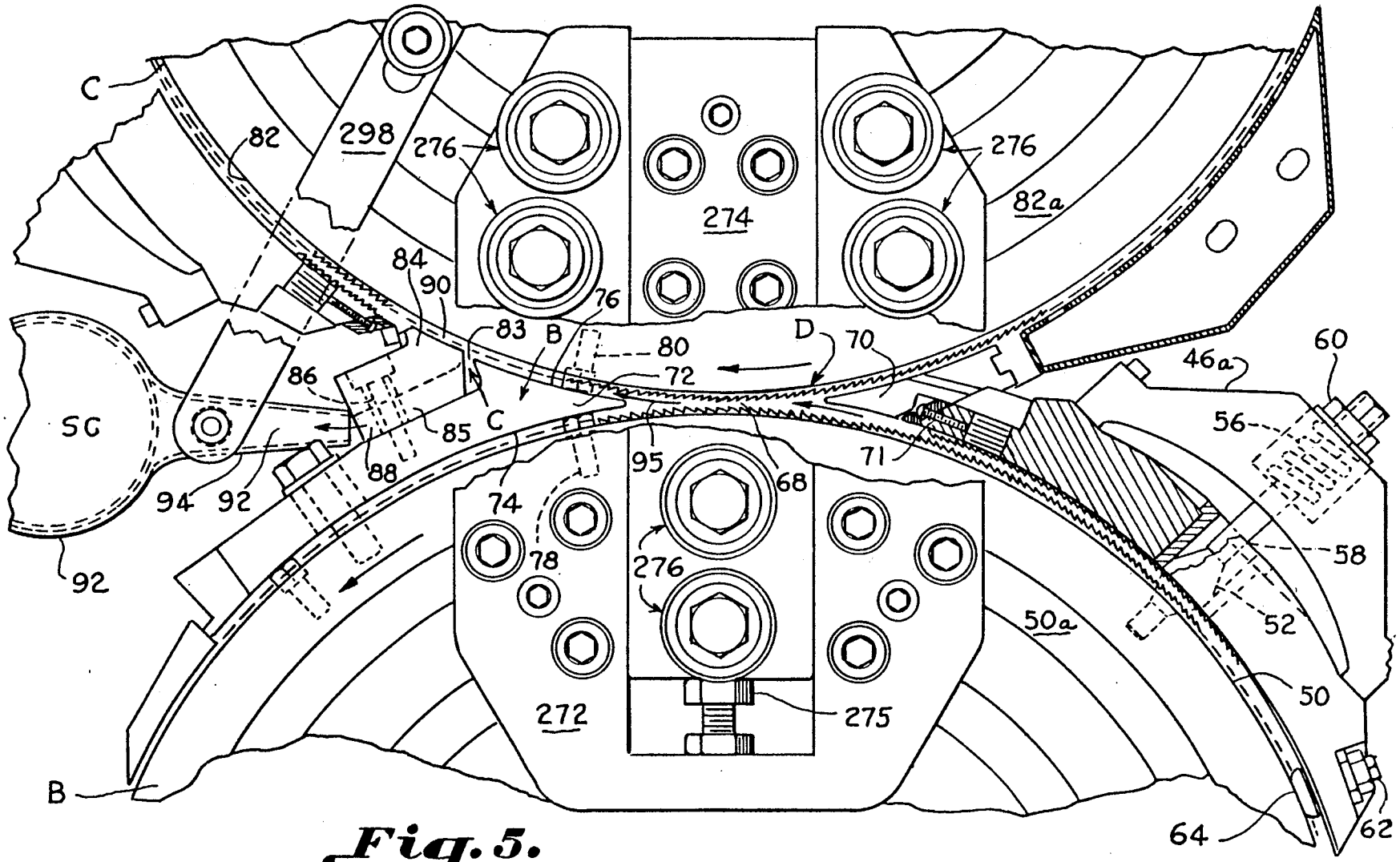
FIG. 5 is an elarged schematic view illustrating the fiber transfer zone between the two main carding cylinders according to the invention in a vertical arrangement.

As can beat be seen in FIGS. 5 and 15, carding plates 40, 42, 44, 46 are adjustably mounted to shrouds 50 carried at the ends of cylinder B so that the distance between the points of the opposing teeth may be varied. The carding plates are set so that the teeth of the carding plates are slightly out of contact with the teeth of cylinder B. This spacing may be anywhere from 0.050 inch to 0.010 inch. The clearance is larger adjacent feed zone 38 and progressively becomes smaller around cylinder B as the fiber tufts become smaller and the carding action becomes finer. The adjustment of the carding plates is done according to standard adjusting techniques for the plates identified previously as Cardmaster carding plates such as shown in U.S. Pat. No. 4,286,357. For example, the carding plates may be attached to shrouds 50 by spherical or tapered studs 52 which are tapped into the shrouds at the ends of cylinder B. Referring to carding plate 46 (FIG. 5), it can be seen that the carding plate is attached by a spring 56 and a shoulder bolt 58 extending through stiffener clamp 46*a*, and threaded into the spherical stud 52. A nut 60 is threaded onto the bolt 58. Carding plates 40, 42, 44 are attached in a similar manner by bolts 58 extending through stiffener 40*a*, 42*a*, 44*a* (FIG. 3). Referring to FIG. 5, there are adjustment screws 62 threaded into the carding plates at their ends which adjust in and out of the plates. An enlarged head 64 bears against cylinder shrouds 50. As screws 62 are adjusted in and out, the clearance space between the opposing teeth points of the carding plates and cylinder may be varied.

As can best be seen in FIGS. 2, 3, and 5, carried above first carding cylinder B is a second, upper clothed carding cylinder C. Preferably, the cylinders are carried generally in a true vertical arrangement as illustrated, however, other upstanding configurations may be provided off of a true vertical, possibly up to 45 degrees off vertical, while retaining significant advantages of the invention. A plane 63 passes through the axes of cylinders B and C (FIG. 2). An important advantage of a generally vertical arrangement is the compactness and availability of a self-standing frame (FIG. 3), and the access to and, strategic location of associated infeeding; transferring, carding, and doffing. Cylinder C serves as a cleaning and finishing cylinder while cylinder B may serve as a breaker cylinder. Cylinder C is preferably a 24 inch diameter roll clothed with conventional metallic wire card clothing rotating in a clockwise direction, as viewed in FIG. 2. Since carding cylinder C may serve to finish the fibers in the carding process, it may preferably be clothed with a population of about 1,000 points per square inch. Other relatively small cylinder sizes may be used depending on the fiber staple being carded. For example, 33 inch diameter cylinders may be used for carding longer, 4 inch staple carpet fibers.

As can best be seen in FIGS. 2 and 5, between the vertically arranged cylinders is a fiber transfer zone, denoted generally as D, in which fibers are transferred from first cylinder B to second cylinder C. Cylinders B and C are in direct fiber transfer relation. That is, there are no transfer rolls between them, and the transferred fiber mass is transferred directly from one cylinder to the other. There is a transfer clearance space 68 between cylinders B and C at transfer zone D which is preferably about 0.012 inches. Their respective teeth 32 and 66 are inclined in the same direction of travel at transfer with cylinder C being more aggressive. The inside of a fiber mass transferred at zone D has been carded on cylinder B. Due to this direct transfer, the opposite side, or outside, of the transferred fiber mass will be effectively exposed for carding on cylinder C. The fiber mass travels counterclockwise and then clockwise, as shown by arrows in FIG. 2, before and after transfer. Clearance 68, direction of teeth 66 and 32, and relative cylinder surface speeds at transfer, together with effective air current control, provide fiber transfer means for transferring and carding opposite sides of the transferred fiber mass. It is noted that the fiber transfer zone of the compact apparatus is horizontal, thus possibly nullifying any significant adverse gravity effects.

At transfer zone D, referring to FIG. 5, there is an adjustable front air control plate 70 attached to carding plate 46 by screws 71. A back air control plate 72 is carried by end shrouds 50 of cylinder B. The back air control plate is adjustable to vary clearance spaces 74, 76 between cylinders B and C, respectively. Clearance 76 is set to be larger than clearance 74 to control fiber and air travel in space 76 and generally control air only through clearance space 74. Some incidental fiber may be conveyed through space 74. For adjusting plate 72 there are adjustment screws 78 threaded into the shrouds 50. Adjustment screws 80 are threaded into shrouds 82 at the ends of cylinder C. By adjusting the screws 78, 80 in and out of the shrouds, spaces 74, 76 are set. There is an adjustable suction slot at 83 formed by an elongated air bar 84 extending across the width of cylinders B and C. Sides 85 of air bar 84 support the bar above the back air control plate 72 and are attached by means of bolts 86. There is a slot 88 defined by air bar 84 generally across its width. Air bar 84 may be set closer or further away from the surface of cylinder C to vary a clearance space 90 and bleed-off more or less air through the slot 83. Air slot 88 is in communication with a suction source SC at 92 by way of a nozzle 94. Front air control plate 70 is set to minimize the clearance between cylinder C and maximize clearance between cylinder B. This controls air off cylinder C coming into fiber transfer zone D facilitating transfer air flow off cylinder B. Front air control plate 70, back air control plate 72, and air slot defining bar 84 provide air control means in transfer zone D for controlling air currents facilitating the transfer of fiber from cylinder B to cylinder C as shown by arrows 95. Air currents, generated by the rapidly rotating cylinder teeth, are directed towards cylinder C and away from cylinder B by back air control plate 72. There is a low pressure in clearance space 76 compared to clearance space 74. A slotted air screen 93 extends across cylinder C and bleeds off air prior to transfer zone D. Screen may be connected to suction source SC. The fiber mass transported by the counterclockwise rotating cylinder B will be reversed and transported by the clockwise rotation of cylinder C. To enable transfer, cylinder C rotates at about a 10 percent faster surface speed than cylinder B. For example, cylinder C may rotate at 800 rpm and cylinder B at 700 rpm. Drafting may occur in transfer zone D in the range of 5 percent negative to 20 percent positive. The fiber mass is transferred in zone D from cylinder B to cylinder C effectively exposing the opposite side of the fiber mass to the carding means of cylinder C.

As can best be seen in FIG. 2, adjacent and downstream from transfer zone D is a fifth stationary clothed carding plate 96 carried by end shrouds 82 of cylinder C like the carding plates on cylinder B. Carding plate 96 is a fine carding plate like carding plates 48, 46. Next to carding plate 96 is a revolving flat assembly denoted generally as E, as can best be seen in FIGS. 2 through 4. Generally, revolving flats have been used for sometime on carding machines such as shown in U.S. Pat. No. 3,604,602. Suitable flats are manufactured by Hollingsworth, Inc. as Flatmaster flats. Since the construction of flats and revolving supporting chains are known, only those features necessary to an understanding and working of the invention will be described in detail. Assembly E includes a pair of spaced side plates 100, 102 which are carried by shrouds 82 of cylinder C. The plates are fastened by bolts 103 into "T" grooves **82*a* formed in the shrouds. Extending between these plates is a central drive shaft 102*a* and sprocket 102 and two stub shafts with idler sprockets 104, 106 on each side plate. While sprockets are described, other equivalent drive transmission elements, i.e. pulleys, are included. Assembly E includes a plurality of revolving clothed flats 108 carried on a chain 109 revolving about the shafts preferably in the direction of arrow 110. It is to be understood that the flats may be selectively rotated in the reverse direction as well. This is a unique feature of the flat assembly and will be described in more detail later. Flats 108 include conventional flexible top card wire clothing 108*a* (FIG. 7), e.g. 500 points per square inch. The flats are set slightly out of contact with the teeth of carding cylinder C and provide a primary and important function of cleaning the fibers in addition to carding the fibers. The revolving flats may be driven at conventional surface speeds relative to cylinder C. For example, cylinder C may rotate at a surface speed of 4000 to 5000 feet per minute and revolving flats 108 may rotate at 4 inches per minute. The back of the flats are cleaned by applying suction cleaning to the backside by way of a suction port 112. A conventional stripper roll 116 is carried in contacting relationship with the wire of the flats for cleaning the flats. A conventional high speed brush roll 118 rotates in close proximity to stripper roll 116** to maintain it clean. Typically, suction removes matter from the stripper roll.

Revolving flats typically are "T" shaped in section (Prior Art FIG. 7A) and are a little longer on both sides than the cylinder is wide. A typical revolving flat assembly is shown in U.S. Pat. No. 3,604,475. The flats are connected by links and to a chain. The distance between the points on the flats and the points on the cylinder is usually about 0.01 inch to 0.028 inch. The side of the flat pointing away from the normal direction of travel is called the toe and the opposite side is called the heel. The heel is generally a little closer to the main cylinder teeth than the toe. This is done to improve the operation and prevent the possibility of damage to the main cylinder of the card. The flats are set at an angle "a" of about 1 to 2 degrees rather than tangent to the carding cylinder. Carding usually occurs only over a portion of the heel. Generally, the curved area or actual carding area of each flat is about 13/16 of an inch and the distance from the teeth of one flat to the teeth of the next flat is about 9/16 of an inch. On the revolving flat portion actually only about 30 percent of the surface provides carding action.

Figures 6, 7:
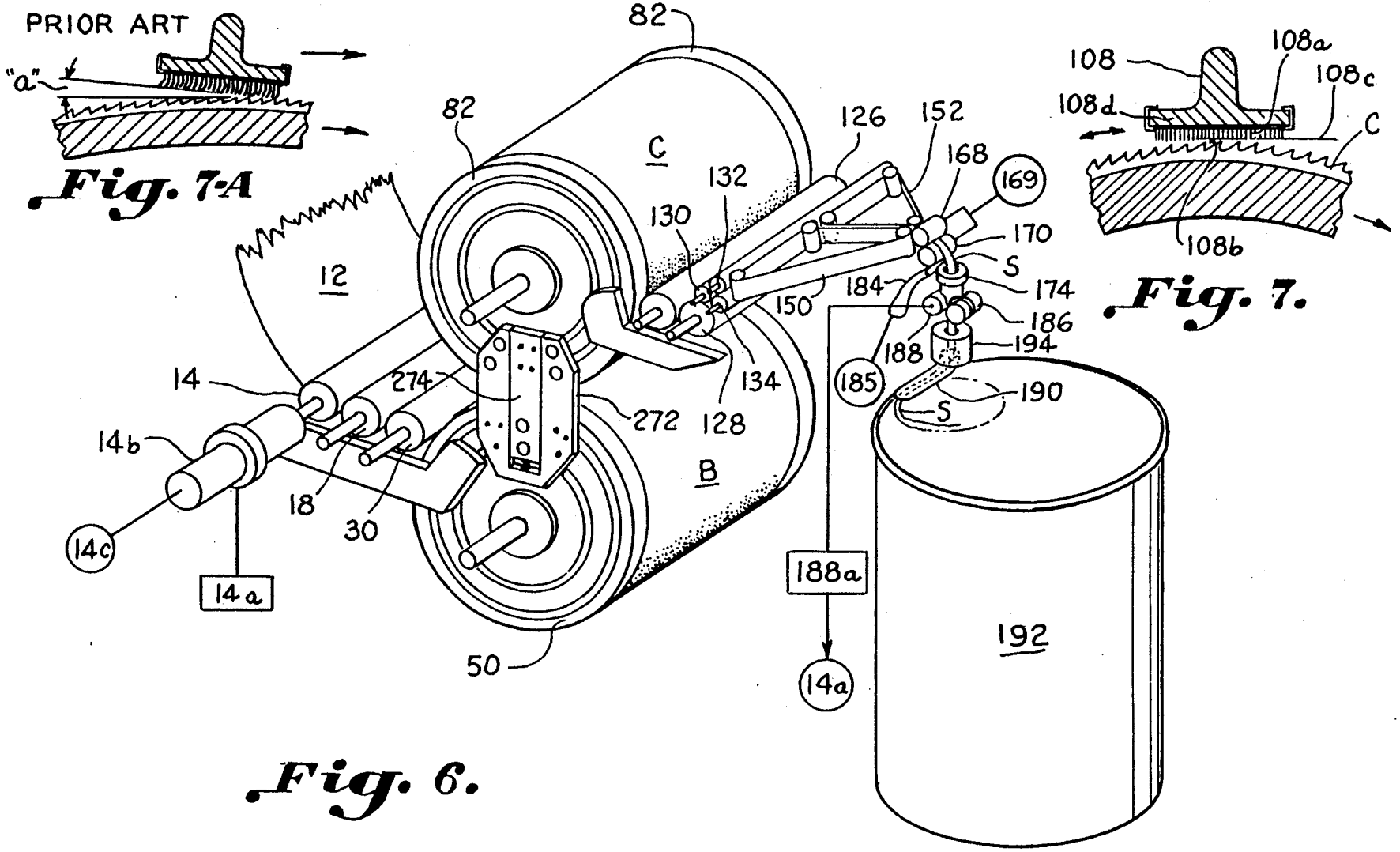
FIG. 6 is a perspective view illustrating carding apparatus and method for automatic thread-up of sliver according to the invention.
FIG. 7 is a sectional view of a carding flat having its center tangential to a carding cylinder in accordance with the invention.

In accordance with the present invention, as can best be seen in FIG. 7, the flats 108 are arranged on assembly E so that a center of the flats and their teeth points are tangential to cylinder C. This means that a center point 108*b* of a plane 108*c* in which the wire points lie is tangential, or parallel to a tangent, to the points surface of cylinder C. This may be accomplished by setting the irons or guides of the flats which ride on a flexible bend 111*a* to guide the flats, at a proper angle with respect to the flat body 108*d* so that teeth 108*c* are tangent at the center point of the flat. As a result of the flats tangent contact, a larger area of the points of the wire 108*a* is available for cleaning and carding as compared to the conventional heel and toe arrangement. The smaller diameter cylinder roll C, rotating at a faster speed than conventional large carding cylinders, is subjected to reduced fiber loading due to increased centrifugal force. The combination of tangent carding flats and increased centrifugal force of smaller cylinder C produces an overall increased cleaning and carding action and capacity. On the downstream side of the flats, suction SC may be applied at 121 to remove fly or other loose particles. A percentage plate 122 is located in this area. There is a sixth clothed carding plate 123 mounted downstream from the revolving flats like carding plates 44, 46, 96 for fine carding.

It can be seen that a second carding means, in addition to the first carding means of cylinder B, is provided in carding relation to cylinder C by stationary plate 96, revolving flat assembly E, and stationary carding plate 123.

As can best be seen in FIG. 2, the vertical arrangement of clothed carding cylinders B and C, the location of fiber feed zone 38, fiber doffing zone 124, and direct fiber transfer at D, provide an extended fiber travel path denoted by dotted line P. The surface area over which the directly transferred fiber mass travels is significantly increased over that of the prior art. For example, by reference to FIG. 2, it can be seen that fibers may be present on all of the surface area of cylinders B and C for carding except for the shaded areas 136. This leaves a fiber path over approximately 80 percent of the total surface area of each cylinder where the fibers may be subjected to a carding action. All of this area may not be useable since it is not desirable to card the fibers immediately prior to entering a transfer zone. Mechanical and structural elements of carding and air control may also reduce the available carding area. However, approximately 75 to 80 percent of the total cylinder area may be useable carding area in the illustrated embodiment. It being understood, of course, that the actual surface area used for carding may be varied without departing from the spirit and scope of the invention, and that mechanical improvements and expedients may increase the useable area of the compact arrangement beyond that illustrated.

In the illustrated embodiment as best shown in FIG. 2, the useable carding area is determined, in large, by the fiber feeding, transferring, doffing, air current control, and other mechanical structures. While it is preferable to use all of the usable carding area, the carding area may range from substantially more than 50 percent and up to approximately 80 percent of the cylinder area while retaining significant advantages and aspects of the invention. The unique carding arrangement provides a very compact carding apparatus which conserves floor space yet which allows increased surface area for carding. The fiber path about the cylinders is considerably extended, yet the arrangement is compact compared to prior tandem arrangements. Considerably more carding action may be provided over prior carding arrangements. The carding plates are arranged from coarse to fine along fiber path P to provide finer carding of the fiber as it progresses around the surface of the cylinders. The revolving flats impart a carding action and clean the fiber for removing the trash. This increase working surface area and combination of carding and cleaning provides a high quality carded fiber which is clean as well. Alternately, if this quality is not needed the apparatus may be used to produce increased quantity by increasing the rotational speed of feed roll 14 and loading the cylinders more.

FIBER DOFFING

Figure 4:
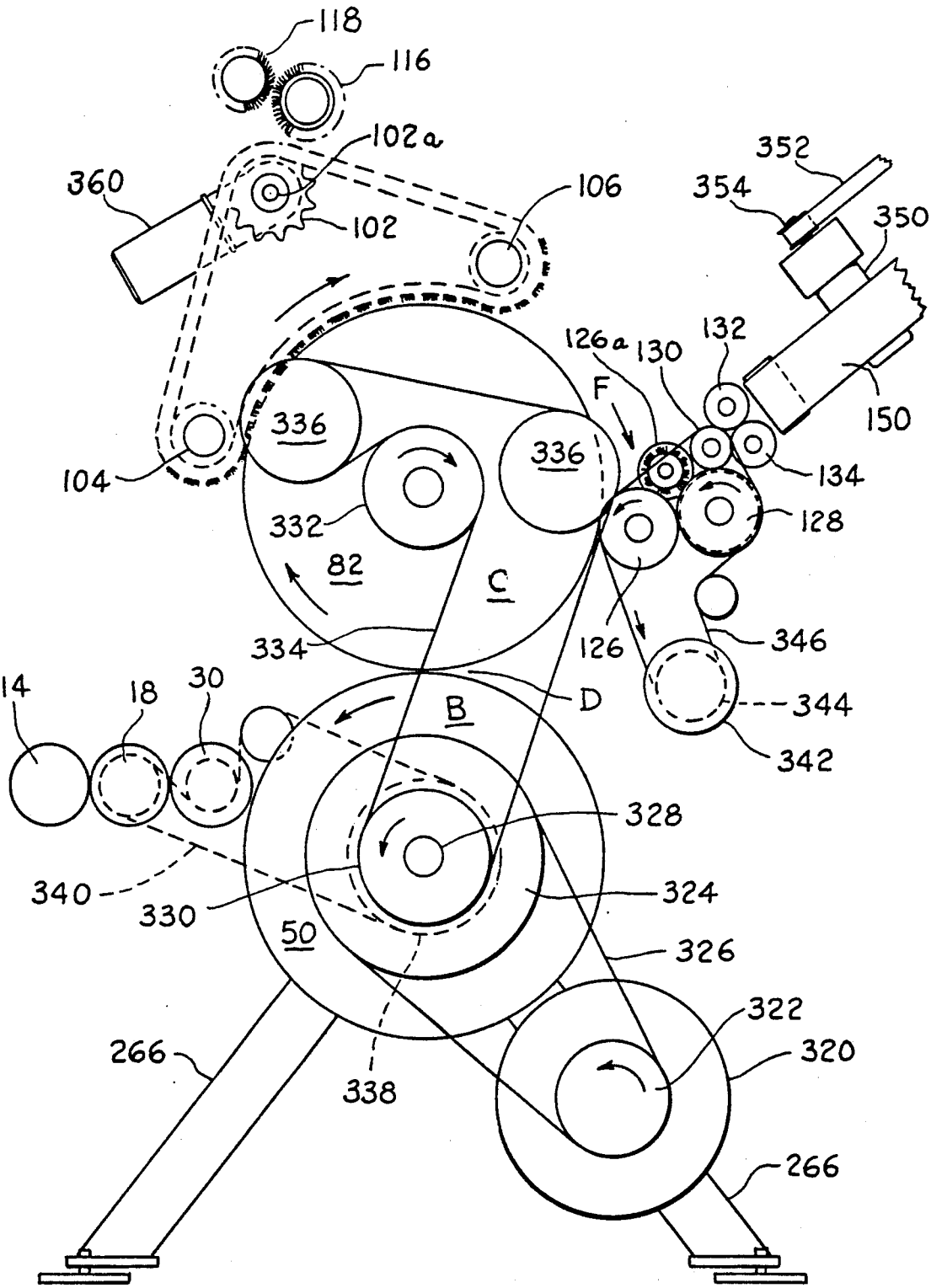
FIG. 4 is a schematic diagram illustrating the drive arrangements for the carding apparatus and method.

As can best be seen in FIGS. 2, 4, and 6, a fiber doffing zone 124 is indicated where fiber is removed from cylinder C and formed into a web W by fiber doffing means denoted generally as F. Doffing zone 124 is preferably generally within a quadrant 124*a* of cylinder C next adjacent fibers transfer zone D. At doffing zone 124, fiber is transferred onto a doffer roll 126, included in doffing means F, from second cylinder C. Doffer cylinder 126 is clothed with conventional metallic wire card clothing, preferably having a population of 375 points per square inch. Doffer 126 is driven counterclockwise in fiber transfer relation and much slower than cylinder C such as 1/20th of the relative surface speed. This allows for removed fibers to be packed onto the doffer forming web W taken off from the carding apparatus. Doffer roll 126 is preferably a 5½ diameter roll, less than 25 percent of cylinder C, which is quite small for a doffer, but is driven faster in combination with smaller, faster cylinder C providing compactness. The web formed on doffer 126 is taken off by a stripper roll 128, also a 5½ inch diameter roll. Roll 128 is clothed with conventional stripper or triangular metallic wire card clothing. Stripper roll 128 rotates at about a 20 percent faster surface speed than doffer 126. There is a 2¾ inch diameter knurled redirect roll 130 which directs web W from stripper 128 to the nip of a pair of smooth 3 inch diameter delivery rolls 132, 134. The delivery rolls then deliver the web to the nip of a transport means in the form of a pair of revolving take-off belts 150, 152. Each of the redirect rolls 130 and pair delivery rolls 132, 134 are driven at a progressively faster surface speed, for example, increased about 10 percent. Approximately 20 percent drafting takes place between the stripper roll 128 and doffer 126. Another 20 percent drafting takes place from stripper 128 to redirect roll 130, and from roll 130 to delivery rolls 132, 134. Total drafting of about 40 percent occurs in the take-off section of the machine. This drafting is held to a minimum only to maintain proper web tension and keep the web traveling. All the suction cleaning (SC) devices may be commuted to a central waste system.

While the preferred and illustrated embodiment shows feed zone 38 on lower cylinder B and doffing zone 124 on upper cylinder C, this arrangement may be inverted, particularly, where the carded product may be a web discharged at the bottom rather than a sliver. Due to the automatic sliver thread-up features of the invention, the embodiment of FIG. 2 is particularly advantageous since coiler can design requires sliver delivery to an elevated point. The specialty rolls, carding cylinders, doffer roll, and carding plates, not already specifically mentioned, may be clothed with conventional, standard metallic wire card clothing available from Hollingsworth, Inc.

SLIVER THREAD UP

Referring now to the drawings, particularly FIGS. 6 through 11, means for automatically forming a sliver S from web W and threading the sliver into a coiling can without manual assistance will be described. As can best be seen in FIG. 9, web W leaving the nip of delivery rolls 132, 134 engages transport means in the form of revolving take-off belts 150, 152. Belts 150 and 152 are preferably perforated, or otherwise made air permeable such as by a significantly open mesh, preferably about 25 percent open. Belt 150 is driven by a drive roller 154 and travels about a pair of idler rollers 155, 156. Belt 152 travels about a drive roller 157 and about a pair of idler rollers 158, 159. A run 150*a* of belt 150 and a run 152*a* of belt 152 are parallel to delivery rolls 132, 134 across the full width of web W. Belt runs 150*a*, 152*a* collect web W delivered by delivery rolls 132, 134 and transport the web toward a center nip 160 where the web is condensed into sliver S and transported between adjacent parallel runs 150*b*, 152*b* to a roller nip 162. The space between runs 150*b*, 152*b* may taper from ¾ inch to slightly less than 1/16 inch at nip 182.

As can best be seen in FIGS. 10 and 11, after leaving nip point 162, sliver S travels through a sliver control means in the form of a segmented trumpet 166 which is formed of two movable segments 166*a*, 166*b* actuated by air cylinders 167 to control the width of sliver S and prevent it from spreading out. After passing through segmented trumpet 166 the sliver travels between the nip of a pair of transfer rolls 168, 170 mounted with their axes 168*a*, 170*a*, 90 degrees to the axes 154*a*, 157*a* of drive rollers 154, 157 (FIGS. 9 and 11). In this manner, the rolls and rollers form a boxed nip through which sliver is delivered. The sliver leaving the nip of the transfer rolls 168, 170 is directed downwardly between a cover 172 and lower transfer roll 170 through a first air trumpet 174 (FIGS. 8 and 11). Compressed air enters a inlet fitting 176 of the air trumpet, passes down through a passageway 178, and exits the trumpet at 180 in a spiral or vortex pattern caused by inclined vanes and grooves 181 in a helix in the outlet air passage. A high velocity of swirled air leaving exit 180 creates a suction effect in the trumpet and draws sliver S down through interior funnel 182. A suction nozzle 184 is disposed adjacent the top of funnel 182 for carrying away undesirable fibrous parts in a chop-dump cycle to be described later in reference to FIGS. 6 and 11.

Passing through trumpet 174, sliver S goes between a tongue-in-groove calendar roll arrangement. The calendar roll arrangement includes a groove roll 186 and a movable tongue roll 188. The tongue-in-groove calendar roll arrangement creates a restricted passage 187 which meters the amount of sliver passing between the rolls (FIG. 13). This gives an indication of the measurement of the sliver density or quantity passing between the rolls and an indication of the output of the card. Tongue roll 188 may be pivotally rotated and its displacements are electronically measured. The displacement signals are used to compute the necessary rate of rotation of feed roll 14 to adjust the input of fibers to the carding machine. This is a common technique used to control the production of a carding machine referred to as "leveling". This can be done in many ways through the use of mechanical and electronic systems.

The sliver leaving the calendar roll arrangement passes through a coiler tube 190 into a coiler can 192 where it is coiled and the can is filled in a conventional manner. There is a second air trumpet 194 carried adjacent the top of coiler tube 190 (FIG. 12). Compressed air, as shown by arrows 195, enters an inlet 196 of the air trumpet and is delivered through a passageway 198 past an exit plate 200 down through the coiler tube 190, carrying sliver S in the airflow. The sliver-transporting air leaves the coiler tube as the sliver is deposited into the coiler can.

Threading of sliver S into coiler can 192 upon card start-up will now be disclosed. In the start-up cycle, cylinders A and B are first turned on for approximately 1 minute to reach their full speed. Next doffer 126 and other take-off rolls are turned on, and then feed roll 14 is turned on. The first step in the automatic thread-up is the chop-dump. When the card is first started, it is relatively unloaded with fiber and the first part of the start up web is irregular and uneven. The first part of sliver formed from the web is uneven with large lumps. The undesirable fibrous parts of the uneven sliver will produce inferior yarn and fabric defects in later processing. Web W is collected by the take-off belts 150, 152 condensed into sliver S, and delivered by transfer means in the form of transfer rolls 168, 170. At this time, the segmented trumpet 166 is opened in the position shown in full lines at 166*a*, 166*b* by cylinder 167 which may be controlled by a solenoid 173. The sliver travels through the open segmented trumpet, between transfer rolls 168, 172. At this time, transfer rolls 168, 170 are driven at a first speed which is faster than the surface speed of take-off belts 150, 152 to provide a fiber removal means. There is approximately a 200 to 300 percent increase in the surface speed of the transfer rolls. There is excessive drafting of the fibers between transport rollers 154, 157 and transfer rolls 168, 170 causing the undesirable fibrous parts of the start-up sliver to be separated and removed. The sliver is pulled apart in large tufts or lumps by the transfer rolls. The pulled apart fibrous parts are dumped into suction tube 184 and carried away as waste. Pulling the fibrous parts from the sliver importantly forms a generally pointed sliver thread-up end at 193. This pointed sliver thread-up end may be easily delivered down into the V-shaped funnel of air trumpet 174. The chop-dump step takes approximately 10 to 15 seconds. After the chop-dump step is completed, the speed of the transfer roll 168, 170 is reduced to a second, normal speed so that it matches the surface speed of transport belts 150, 152. Any conventional control 169 may be provided for driving and controlling transfer rolls 168, 170. A suitable drive is shown in FIG. 14. Suction at 184 is cut off by suitable control 185. Air is turned on at the air trumpets 174, 194 by any suitable switch or time control 174*a*, 194*a*. The thread-up cycle continues, after the chop-dump steps with the pointed sliver entering first trumpet 174. The pointed sliver 193 facilitates entry into passage 187 and the nip of the tongue-in-groove calendar rolls rotating. Sliver is delivered into the second air trumpet 194 where it is injected by air downwardly through the coiler tube 190 and into the coiler can 192 for coiling inside the can. As the card machine reaches its production speed, the segmented gates 166*a*, 166*b* are closed in the dotted line position by cylinder 167 to contain the sliver and prevent it from spreading out over the surface of the transfer rolls. It takes approximately 1 or 2 seconds for the pointed sliver to be threaded into the can 192 after the chop-dump step. Controls 169, 185, 174*a*, 194*a*, may be any conventional switching controls to control the speed, suction, and air injection described above either manually or automatically as is well within the purview of one skilled in the control art.

It will be noted that take-off belts 150, 152 are perforated to dissipate air currents accompanying web W. In this manner, the fibers in the web are held in contact with the belts so that the fibers may be effectively condensed and drawn into sliver as transported by the belts. Otherwise, it has been found that the fibers tend to spread out over the belt height making condensing of the web and drawing it into sliver less reliable and effective. The air impels the fiber against the belts as air passes outwardly through the belts where the fibers are held in contact in a relative narrow band without excessive spreading.

As can best be seen in FIGS. 11 and 14, a drive for the coiler 159 includes an electric motor 210 having an output pulley 212 affixed to its drive shaft. A timing belt 214 drives a pulley 216 from the output pulley 212. Pulley 216 drives a jackshaft 218 onto which two additional pulleys are mounted, 220, 222. Pulley 220 drives pulley 221 via timing belt 221*a*, and pulley 221 drives a gear box 223 which drives the coiler can platform 224 through a belt 225. Pulley 222 drives a pulley 226 affixed to a gear box input shaft 230. Shaft 230 drives a pulley 228 which drives a coiler tube gear 234 via belt 236 which turns coiler tube 190 to coil sliver in the can in a conventional manner. Input shaft 230 drives a gear box 238 which may be any suitable conventional beveled gear box. The output pulley 239 of beveled gear box 238 drives a pulley 240 connected to a drive shaft 241 of grooved calendar roll 186. Tongue roll 188 rotates by friction with groove roll 186. Belt 242 from pulley 239 of gear box 238 also drives a pulley 246 rotatably journaled on a shaft 248. A spur gear 250 affixed to pulley 246 drives a spur gear 252 connected to the drive shaft 254 of transfer roll 170. Belt 242 drives another pulley 256 affixed to a shaft 258 to drive transfer roll 168. Motor 210 may be variable speed and controlled by a conventional control 169 to speed up the transfer rolls during the chop-dump step.

FRAME

As can best be seen in FIGS. 1, 3, 15, and 16, a unique frame arrangement is provided for supporting cylinders B and C and the carding apparatus in a self-standing manner. A frame means includes a base frame 260 which consists of horizontal base legs 262 supported on foot rest 264 which may be vertically adjustable. Suitable cross frame members (not shown) connect base legs 262. Standards 266 connected to each horizontal leg 262 extend upwardly and may be bolted into "T" grooves 50*a* of shrouds 50 at each end of cylinder B. Means for mounting cylinder C generally stop cylinder B is provided by mounting means denoted generally as 270 which includes a first plate 272 rigidly attached to each shroud 50 and a second plate 274 rigidly attached to each shroud 82 of cylinder B (FIG. 3). Plates 272 are movably attached to shrouds 82 and plates 274 are movably attached to shrouds 50. A set member in the form of a nut 275 limits the downward motion of plate 274 which may move vertically relative to plate 272. Nut 275 provides a means for setting the transfer clearance 68 between cylinders B and C. This feature of mounting means 270 allows upper cylinder C to move radially outward with respect to cylinder B. This protects the surface of the cylinders against crushing should a lump, or other large mass be passed between the cylinders B and C. For this purpose, there are provided a plurality of movable attachments 276 which fasten plates 272 and 274 to the "T" grooves of the respective shrouds but allow for relative vertical movement between the plate and its attached shroud. As can best be seen in FIG. 16, there is a vertical space 278 formed in the attachment opening of each attachment 276. A bolt 280 is inserted through space 278 and threaded into "T" grooves 50*a* by a nut 282. There is a Bellville washer 284 between a pair of washers 286 and 288. This Bellville washer allows bolt 280 to be tightened sufficiently to hold plate 272 to the shroud 50. At the same time, tightened bolt and double washer 284 will allow either plate 272 or 274 attached by adjustable attachments 276 to slide vertically to release forces accompanying passes of a large lump between the nip of cylinders B and C. A collapsable bead 290 is positioned between opposing shrouds 50 and 82 for sealing.

The entire carding apparatus may be self-standing. As can best be seen in FIG. 3, an arm 292 may support the fiber feed means A. An arm 294 may support the fiber doffing means F consisting of the various rollers and bearings. A girth 296 is attached to shrouds 82 of cylinder C to hold the assembly of shrouds and cylinder together. The various other attachments and mechanical features of the card may be supported off of the shrouds. For example, suction at 92 may be held by braces 298. Revolving assembly E is attached by bolting into "T" grooves 82*a* of shrouds 82. The various other mechanical attachments of the peripheral elements needed to complete the carding apparatus may be attached as illustrated. For example, the take-off belt assembly of transport belts 150 and 152 may be supported on an arm 300 and adjustable turn buckle 302 arrangement. Chute feed 10 may be carried on a roller base denoted generally as 304 which includes a tubular leg 306 having a vertically adjustable rear wheel 308 received in tubular horizontal legs 262 of base frame 260. The frames may be secured together by an adjustable turn buckle 310. As a particular advantage, the coiler assembly may be pivoted at 312 to the base of the carding apparatus so that it may be pivoted out of the way for access to the front of the carding apparatus. In a like manner, chute feed 10 may be rolled rearwardly by quick detachment so that access may be had to the rear of the carding apparatus.

DRIVE

While any suitable drive arrangements may be provided for the various elements of the apparatus described, a preferred drive arrangement for the carding apparatus includes a separate drive for the main carding cylinders, the feed roll, the doffing rolls and the revolving flat assembly E. As can best be seen in FIG. 4, the drive means for carding cylinders B and C includes an electric drive motor 320 whose output drive pulley 322 is connected to a large drive pulley 324 of cylinder B by a V-belt 326 to drive carding cylinder B. Affixed to shaft 328 of cylinder B is a step-down drive pulley 330 connected to a smaller drive pulley 332 of cylinder C by means of a V-belt 334 and idler pulleys 336. The pulley arrangement results in cylinder C being driven at a somewhat faster rotational speed than cylinder B. Pulley 332 is smaller than pulley 330 so that cylinder C is driven at a faster rotational speed than cylinder B. Preferably, cylinder C rotates at about a 10 percent increased surface speed relative to cylinder B to effect fiber transfer at fiber transfer zone D.

Drive means for feed roll 14 may include any suitable drive such as a variable speed electric motor **14*b* controlled by control 14*c*. This motor may be controlled in response to the displacement of pivotal cylinder roll 188 and control signal 188*a*, and leveling controls. On the opposite end of shaft 328 is a pulley 338 which drives licker-in roll 18 and redirect roll 30 by a belt 340. Referring to the drive means for doffing means F, there is an electric drive motor 342 whose output pulley 334 drives a timing belt 346. Timing belt 346 engages a gear drive pulley (not shown) on the shafts of doffer 126 and stripper roll 128 to drive them accordingly as shown by arrows. Belt 346 also drives knurled transfer roll 130. Delivery rolls 132, 134 are driven by meshing gears (not shown) on their shafts which mesh with a gear (not shown) on the shaft roll 130. These gears are on the backside of the rolls as shown in FIG. 4. The 10 percent draft between the rolls is provided by variations in the gear teeth on the gears. Take-off belts 150, 152 are driven by an electric motor 350 through a timing belt 352 connected between a gear pulley 354 on the output shaft of the motor. Belt 352 drives gear pulleys 154*b*, 157*b* mounted on the drive shafts of drive rollers 154, 157, as can best be seen in FIG. 11**.

The revolving flat assembly E is driven directly by an electric motor 360 through a 90 degree gear arrangement connected to drive shaft **102*a* of sprocket 102. Motor 360 may be any suitable electric motor that is reversible to drive the traveling flats 108** in either the clockwise or counterclockwise direction as previously described.

Thus it can be seen that a highly advantageous construction can be had for carding apparatus according to the invention. The compact, upstanding arrangement provides for close feeding from a vertical chute and thread-up into a coiler adjacent the other side of the upstanding arrangement compactly. At the same time, the fiber feed, transfer, and doffing of the upstanding arrangement provides increased fiber carding, even though a smaller diameter carding cylinder is used. In one example of a 1 meter card, a compact arrangement was provided having a length of 140 inches (3550 mm), width of 129 inches (3280 mm) and a height of 89 inches (2255 mm) or 101 inches (2570 mm) including the vertical chute feed. Production of a very high quality of a carded product may exceed 220 pounds (100 kg) per hour and sliver delivery speed greater than 400 m/min. at 4.2 ktex (59 gr/yd.). All fibers may be processed on the apparatus. The apparatus is designed for the cotton system which includes man-made fibers and blends to 100 mm (4 inches); 0.06 dtex and coarser.

While a preferred embodiment of the invention has been described using specific terms, such description is for illustrative purposes only, and it is to be understood that changes and variations may be made without departing from the spirit or scope of the following claims.

What is claimed is:

1. Apparatus for threading up a textile sliver produced from a web on a textile carding machine upon start-up of said machine, said apparatus comprising in combination:

(a) transport means for collecting said web from said carding machine and condensing said web into a sliver;

(b) a pair of transfer rolls having a transfer nip for receiving said sliver;

(c) drive means for operating said transfer rolls at a first surface speed to produce a faster sliver delivery speed than said transport means causing excessive drafting of said sliver during start-up to progressively separate fibrous parts from the end of said start-up sliver and form a generally pointed sliver thread-up end; and said drive means driving said transfer rolls at a second surface speed to produce a sliver delivery speed generally equal to said transport means after said excessive drafting;

(d) conveyor means for conveying said fibrous parts away from said sliver;

(e) condensor means disposed downstream of said conveyor means for receiving said thread-up end and sliver from said transfer means for condensing said sliver; and (f) delivery means for drawing said sliver through said condensor means.

2. The apparatus of claim 1, wherein said condensor means includes a trumpet having an air injection inlet through which air may be injected through said trumpet to facilitate the passage of sliver through said trumpet.

3. The apparatus of claim 1, including sliver sensing means downstream of said trumpet which engages said sliver for sensing a function of the sliver amount; and said delivery means for delivering said condensed sliver from said trumpet to a textile coiler.

4. The apparatus of claim 1, wherein said transport means comprises a perforated take-off belt means permeable to air and impervious to said fibrous web to facilitate retention of said fibers on said belt means during collection of said web.

5. The apparatus of claim 1, wherein said transport means comprises a pair of perforated driven take-off belts having a first run generally across a width of said web which collect said web, said first runs converging generally to a nip between which said web is collected and condensed into a sliver; said take-off belts having a second run extending from said nip to a roller nip through which said sliver is delivered.

6. The apparatus of claim 1 including sliver control means between said transport means and transfer rolls for controlling sliver spread.

7. Apparatus for threading up a textile sliver produced from a web on a textile carding machine upon start-up of said machine, said apparatus comprising in combination:

(a) transport means for collecting said web from said carding machine, condensing said web into a sliver, and transporting said sliver;

(b) transfer means receiving said sliver from said transport means, said transfer means having a first operational speed at which said transfer means delivers sliver faster than said transport means for progressively separating fibrous parts from a start-up sliver produced by said carding machine at start-up and for forming a generally pointed sliver thread-up end, and a second operational speed for delivering sliver from said transport means to a condensor means;

(c) conveyor means for conveying said fibrous parts away from said sliver which said transfer means separates at said first operational speed;

(d) condensor means receiving said sliver thread-up end and sliver for condensing said sliver at said second operational speed of said transfer means; and (e) delivery means for delivering said sliver through said trumpet means into a textile coiler.

8. The apparatus of claim 7 including fiber sensing means receiving said condensed sliver for sensing the quantity of said sliver and generating a signal indicating the quantity of sliver delivered through said condensor means; and a textile coiler for receiving said sliver and depositing said sliver into a coiling can.

9. The apparatus of claim 7, wherein said transfer means includes a pair of transfer rolls, and drive means for driving said transport rolls at said first speed subjecting said sliver to excessive drafting and causing said fibrous parts to become pulled and separated from said start-up sliver.

10. The apparatus of claim 9, wherein said transport means includes a pair of transport rollers having their axes of rotation generally perpendicular to the axes of rotation of said transfer rolls forming a box nip positively controlling said sliver during separation.

11. The apparatus of claim 7, wherein said transport means includes a pair of traveling take-off belts which collect said web from said carding machine and condense said web into said sliver, said take-off belts comprising perforated belts permeable to the air coming off with said web to facilitate holding of said fibers against said take-off belts and prevent said fibers from spreading out across the height of said belts.

12. the apparatus of claim 7, wherein said fiber removal means includes a suction device positioned adjacent the path of said sliver emerging from said transfer means which sucks away said undesirable pieces of sliver.

13. The apparatus of claim 7 including a sliver control means positioned between said transport means and transfer means which controls the width of sliver passing through said transfer means.

14. The apparatus of claim 13, wherein said sliver control means includes a pair of movable segments, said segments being movable towards and away from each other to a selective open position and to a closed position, said segments controlling the tendency of said sliver to spread out in said closed position.

15. The apparatus of claim 7, wherein said condensor means comprises:

(a) an air trumpet having an inlet which said thread-up end enters and an exit through which said sliver exits;

(b) an air inlet formed in said air trumpet and an air outlet formed adjacent said exit of said air trumpet; and (c) means injecting air through said inlet and outlet causing withdrawal and passage of sliver through said air trumpet.

16. The apparatus of claim 15, wherein said air outlet of said trumpet includes vortex means for inparting a vortex pattern to the flow leaving said air trumpet causing said sliver to twist and said thread-up end to become more pointed for subsequent threading up.

17. The apparatus of claim 16, wherein said vortex measn includes a plurality of inclined vanes arranged at said air outlet and sliver exit.

18. The apparatus of claim 16 including:

(a) a pair of calendar rolls;

(b) one of said calendar rolls having a groove formed about its circumference extending radially inwardly;

(c) another of said calendar rolls including a tongue which fits into the groove of said groove roll; and (d) a sliver metering passage formed between said tongue and groove through which said pointed sliver thread-up end is inserted.

19. The apparatus of claim 7, wherein said coiler comprises a coiler tube through which sliver passes;

(a) an inlet carried atop said coiler tube;

(b) a second air trumpet carried in said inlet of said coiler tube having an air inlet passage through which air enters and an air outlet passage through with air exits; and (c) means injection air through said second air trumpet in the direction of flow of said sliver to assist said sliver in its passage through said coiler tube.

20. A method of threading a sliver produced from a web on a textile carding apparatus into a coiler can upon start-up of said apparatus said sliver being condensed from the web delivered by a pair of delivery rolls from the carding apparatus, said method comprising:

(a) collecting said web from said delivery rolls and condensing said web into said sliver;

(b) pulling fibers from the end of said sliver to separate large lumps and other fibrous parts from said sliver formed on start-up and to create a generally pointed end on said sliver for thread-up;

(c) conveying said separated fibrous parts away from said sliver;

(d) terminating said fiber pulling and separation and conveying away;

(e) condensing said sliver; and (f) delivering said condensed sliver to a textile coiler.

21. The method of claim 20 including pulling said fibers by holding it between a nip of a pair of transport rollers and a nip of a pair of transfer rolls and driving said transfer rolls at a faster surface speed than said transport rollers to subject fibers to excessive drafting and separation from the end of said sliver.

22. The method of claim 21 including arranging the axes of said transfer rolls and transport rollers generally perpendicular to each other forming a box nip for positive fiber control.

23. The method of claim 20 including removing said separated fibrous parts by air suction to a remote location.

24. The method of claim 20 including imparting a twisting motion to the sliver thread-up end after condensing to form a more pointed end for subsequent threading up.

25. The method of claim 24 including threading said thread up end through a metering passage formed between a tongue roll and a groove roll which fit together to meter the silver passing through said passage, and sensing the displacement of one of said tongue and groove rolls to indicate the quantity of sliver being delivered.

26. The method of claim 20 including passing said pointed thread up end of said sliver through a second air trumpet which assists the flow of said sliver through a coiler tube into a coiler can of said textile coiler.

27. A method for automatically threading up a textile sliver produced from a web upon start-up of a textile carding machine, said method comprising the steps of:

(a) collecting and condensing said web into a sliver;

(b) transporting said sliver by a transport means to a transfer means;

(c) operating said transfer means at a faster rate than said transport means to pull fibrous parts from a start-up sliver and form a thread up end on said sliver;

(d) conveying said fibrous parts away from said sliver;

(e) terminating said fiber pulling and fibrous parts separation by reducing the rate of operation of said transfer means;

(f) delivering said sliver thread up end through a trumpet means which condenses said sliver; and (g) conveying said sliver to a coiler tube of a coiler for depositing said thread up end and a sliver into said coiler can.

28. The method of claim 27 including reducing the speed of said transfer means to that of said transport means after said fibrous parts have been removed from said sliver and said thread up end has been formed; and terminating the separation and conveyance of said fibrous parts after said transfer means has been reduced in its speed to that of said transport means.

29. The method of claim 28 including passing air through said trumpet means to facilitate the flow of sliver through said trumpet means; and imparting a swirling motion to said air as said sliver leaves said trumpet means to impart a twisting action to said thread up end of said sliver to facilitate subsequent threading.

30. The method of claim 29 including passing said thread up end of said sliver to a second trumpet means adjacent to a coiler tube and injecting air through said second trumpet to facilitate the flow of sliver into said coiler.

31. The method of claim 27 including passing said sliver through a segmented trumpet positioned between said transport means and transfer means;

opening said trumpet to provide a wider passage for said sliver during removal of fibrous parts from said silver; and closing said trumpet to control the width of the passage through said segmented trumpet after said fibrous parts have been removed and the operating rate of said transfer rolls have been reduced.

* * * * *